US006321927B2

(12) United States Patent
Cavella

(10) Patent No.: US 6,321,927 B2
(45) **Date of Patent: *Nov. 27, 2001**

(54) BEVERAGE CAN SEAL

(76) Inventor: Michael Cavella, 914 Baier Ave., Louisville, OH (US) 44641

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/356,942

(22) Filed: Jul. 19, 1999

Related U.S. Application Data

(60) Provisional application No. 60/093,287, filed on Jul. 17, 1998.

(51) Int. Cl.[7] ..... B65D 51/18; B65D 51/22

(52) U.S. Cl. ..... 220/359.2; 220/257; 220/258; 220/906

(58) Field of Search ..... 220/254, 256, 220/257, 258, 265, 266, 268, 269, 270, 906, 359.1, 359.4, 359.2, 276

(56) References Cited

U.S. PATENT DOCUMENTS

| | | | |
|---|---|---|---|
| Re. 27,518 | | 10/1972 | Brown . |
| D. 259,403 | | 6/1981 | Frazier, Jr. . |
| 1,878,677 | | 9/1932 | Curtis . |
| 3,204,805 | | 9/1965 | May . |
| 3,438,533 | | 4/1969 | Hanisch . |
| 3,637,104 | | 1/1972 | Dutnell . |
| 3,690,509 | | 9/1972 | Kinoian . |
| 3,812,993 | | 5/1974 | Yoshioka . |
| 3,990,615 | | 11/1976 | Kerwin . |
| 4,002,516 | | 1/1977 | Gaborieau . |
| 4,429,804 | | 2/1984 | Pease . |
| 4,511,057 | | 4/1985 | Tontarelli . |
| 4,705,186 | | 11/1987 | Barrash . |
| 4,708,257 | | 11/1987 | Deline . |
| 4,895,270 | | 1/1990 | Main . |
| 4,913,304 | | 4/1990 | Corey . |
| 4,917,260 | | 4/1990 | Heyes . |
| 4,927,048 | | 5/1990 | Howard . |
| 5,014,869 | | 5/1991 | Hammond . |
| 5,108,003 | | 4/1992 | Granofsky . |
| 5,119,955 | | 6/1992 | Granofsky . |
| 5,131,554 | * | 7/1992 | Kuo ..... 220/258 |
| 5,292,022 | | 3/1994 | Blanco . |
| 5,647,497 | * | 7/1997 | Labbe ..... 220/257 |
| 5,692,633 | * | 12/1997 | Gordon ..... 220/253 |
| 5,893,477 | * | 4/1999 | Kaneko et al. ..... 220/257 |
| 5,934,495 | * | 8/1999 | Chiodo ..... 220/257 |
| 5,996,832 | * | 12/1999 | Nieuwoudt ..... 220/257 |
| 6,015,059 | * | 1/2000 | Takayama ..... 220/258 |

* cited by examiner

*Primary Examiner*—Allan N. Shoap
*Assistant Examiner*—Niki M. Eloshway
(74) *Attorney, Agent, or Firm*—John M. Vasuta

(57) ABSTRACT

A seal for use on a container such as a beverage or food storage container and more specifically such as a soft drink, beer, or soup can where the seal prevents contamination of the rim or lip, trough and area adjacent to and surrounding the drinking aperture as well as between the drinking aperture and the nearest rim. The seal covers the inner surface of the rim but does not restrict use of 6-pack rings or the like, nor does the seal interfere with stacking of the cans. The seal further includes a peel tab.

13 Claims, 4 Drawing Sheets

BEVERAGE CAN SEAL

This application claims benefit of Provisional Application Ser. No. 60/093,287, filed Jul. 17, 1998.

BACKGROUND OF THE INVENTION

1. Technical Field

The present invention relates to a seal for a can or other similar container such as a metal can used for storage of beverages such as soft drinks, beer, juices, etc. More particularly, the present invention relates to a thin film, removably adhered to the top of such cans for preventing contamination of the drinking area surrounding the pull or lift tab and the opening made thereby in the top of the can. Specifically, the present invention is a thin film that covers and either seats within or spans over the circumferential groove in the top of the can around its periphery where the film extends up the inner surface of the outer rim or lip on the top of the can and also extends inward adjacent the pull or lift tab to cover the depressible door under the pull or lift tab, while the entire thin film is designed to still allow for both stacking of the can with an identical can as is well known in the industry, and connecting multiple cans together using "6-pack" rings or the equivalent thereof as is well known in the industry.

2. Background Information

It is well known in the food and beverage/drink industry to store food and drink in various containers for a variety of reasons. These reasons include convenient storing, packaging and transporting of the food and beverages both in bulk for wholesale and in small quantities for retail sale to consumers. As is well known, beverages are a very popular item to be stored in containers and made available in many convenient locations. Examples include soft drinks, beer, juices, etc. Consumers demand these beverages be made available through vending machines and food counters, at restaurants and in grocery stores, in ball parks and arenas, etc. So as to provide a consumer friendly size and shape that is easily used in the vending machines as well as through retail establishments, and for easy consumer purchase and transportation in dividable bulk, the beverage industry invented the cylindrical shaped, closed ended can as is well known in the industry as a soda or pop can.

This soda or pop can is generally cylindrical in shape although it may vary into other similar shapes. This soda or pop can is further generally manufactured of a metal such as aluminum, tin, steel, or other well known metals having the necessary properties of can formation including high strength, light weight, thin walled capability, corrosion resistance, etc. This soda or pop can is often of a twelve (12) or sixteen (16) ounce variety although numerous other sizes are well known in the art including eight (8), twenty (20), twenty-four (24) and thirty-two (32) ounce sizes.

In design, these soda or pop cans generally have a pair of opposed spaced apart end walls with a cylindrical shape side wall therebetween, one of the end walls includes an access means that is typically embodied as some form of pull or lift tab adjacent a removable or depressible door with a score line therearound for defining an aperture when removed or depressed. These soda or pop cans are generally designed such that the cylindrical side wall tapers inward into an axially outward circular lip or rim. Depending upon the manufacturing process, this rim may be the bead where the side wall and end wall was compressed together during manufacture, but in any case this rim is necessary for stacking as the upper rim, that is the rim corresponding with the end wall having the depressible door therein, is of a larger diameter than the lower rim, that is the other rim which lacks any door or tab, so as to receive a lower end wall from an other can and thereby allow for stacking thereof. Each end wall is perpendicularly positioned inside the circular lip or rim, offset axially into the can to define an indented end pocket that serves as a seat for another can, and extends radially inward from the side wall and bead combination to a central axis of the can thereby enclosing the ends of the can. Each end wall includes a circular trough adjacent the bead which is formed as part of the can making process.

It is well known that these cans encounter dirt and other contaminants during manufacture, assembly or filling, transportation and storage. As is often the case, dirt and other contaminants are deposited in the indented end pocket on the end wall, and particularly along the rim or lip, and in the trough. This is problematic in that the depressible door and the area therearound always comes in contact with the liquid contents when these contents are poured out of the can, whether directly into the mouth of a consumer or alternatively into another container for consumption therefrom. In addition, when the liquid is directly consumed from the can, the mouth and specifically the lips are often placed in direct contact with the can including the rim and the trough. It is the din and other contaminants on this rim and trough that are of concern to many consumers.

Many solutions have been proposed, each of which has achieved, in varying degrees, at least some improvement to the general state of the art. However, all of the prior art has failed to produce an improved beverage can seal that effectively eliminates the dirt and other contaminants from the repressible door and area adjacent thereto as well as the rim and trough while not otherwise affecting the can design.

Numerous of these solution attempts have been patented including U.S. U.S. Pat. No. 1,878,677 (Curtis, 1930), U.S. Pat. No. 3,204,805 (May, 1963), U.S. Pat. No. 3,438,533 (Hanisch, 1969), U.S. Pat. No. 3,637,104 (Dutnell, 1972), U.S. Pat. No. 3,690,509 (Kinoian, 1972), Re 27,518 (Brown, 1972), U.S. Pat. No. 3,812,993 (Yoshioka, 1974), U.S. Pat. No. 3,990,615 (Kerwin, 1976), U.S. Pat. No. 4,002,516 (Gaborieau, 1977), D259,403 (Frazier, 1981), U.S. Pat. No. 4,429,804 (Pease, 1984), U.S. Pat. No. 4,511,057 (Tontarelli, 1985), U.S. Pat. No. 4,705,186 (Barrash, 1987), U.S. Pat. No. 4,708,257 (Deline, 1987), U.S. Pat. No. 4,895,270 (Main, 1990), U.S. Pat. No. 4,913,304 (Corey, 1990), U.S. Pat. No. 4,917,260 (Heyes, 1990), U.S. Pat. No. 4,927,048 (Howard, 1990), U.S. Pat. No. 5,014,869 (Hammond, 1991), U.S. Pat. No. 5,108,003 (Granofsky, 1992), U.S. Pat. No. 5,119,955 (Granofsky, 1992), and U.S. Pat. No. 5,292,022 (Blanco, 1994). These patents focus on all different types of devices for sealing containers, providing sterile drinking containers, providing protective covers, supplying closures for cans, providing hygienic covers for cans, providing easy opening cans, providing for convenience opening of cans, providing a mechanism for resealing cans, providing caps that temporarily hermetically reseal cans, and so on.

Although each of these prior art inventions achieves at least some of its stated objectives, these prior art inventions do not solve the current problems associated with beverage and similar cans, and/or each have disadvantages associated with its manufacture or use. These current problems and disadvantages are apparent as none of the prior art inventions is commercialized as a solution to the contaminants problem that plagues soda or pop cans. This is readily apparent in that soda or pop cans come lacking of any seal, and cleanliness concerned consumers are readily seen washing, wiping or otherwise cleaning the tops of the cans prior to drinking.

OBJECTIVES AND SUMMARY OF THE INVENTION

It is an objective of the present invention to provide an improved beverage or food product container.

It is further an objective of the present invention to provide an improved soft drink (soda or pop), beer, or soup can.

It is further an objective of the present invention to provide an improved soft drink (soda or pop), beer, or soup can having a seal thereon.

It is further an objective of the present invention to provide an improved soft drink (soda or pop), beer, or soup can having a contaminant prevention means.

It is further an objective of the present invention to provide an improved soft drink (soda or pop), beer, or soup can having a seal for preventing contamination of the drinking area of the can.

It is further an objective of the present invention to provide an improved soft drink (soda or pop), beer, or soup can having a seal that prevents contamination of a portion or all of the lip or rim of at least one end of the can.

It is further an objective of the present invention to provide an improved soft drink (soda or pop), beer, or soup can having a seal that prevents contamination of a portion or all of the trough of at least one end of the can.

It is further an objective of the present invention to provide an improved soft drink (soda or pop), beer, or soup can having a seal that prevents contamination of the area in the end wall between the drinking aperture (as defined by the dispensable door once opened) and the lip or rim of the can.

It is further an objective of the present invention to provide an improved soft drink (soda or pop), beer, or soup can having a seal that prevents contamination of the area in the end wall surrounding and/or adjacent to the drinking aperture (a defined by the dispensable door once opened).

It is further an objective of the present invention to provide an improved soft drink (soda or pop), beer, or soup can having a seal that prevents contamination of the lip or rim, the trough, and the drinking area surrounding or adjacent to the drinking aperture (as defined by the dispensable door once opened) and between the drinking aperture and the nearest rim portion.

It is further an objective of the present invention to provide an improved soft drink (soda or pop), beer, or soup can having a seal of a thin, peelable, and nontoxic nature.

It is further an objective of the present invention to provide an improved soft drink (soda or pop), beer, or soup can having a seal that is thin and follows the contours of the can.

It is further an objective of the present invention to provide an improved soft drink (soda or pop), beer, or soup can having a seal that is thin and follows the contours of the can in such a manner so as to still allow stacking of the cans.

It is further an objective of the present invention to provide an improved soft drink (soda or pop), beer, or soup can having a seal that includes a lift tab that is not adhered to the can for providing easy peeling or other removal of the seal.

It is further an objective of the present invention to provide an improved soft drink (soda or pop), beer, or soup can having a seal that prevents contamination in all drinking areas but simultaneously does not interfere in any way with the stacking of the cans.

It is further an objective of the present invention to provide an improved soft drink (soda or pop), beer, or soup can having a seal that prevents contamination on all drinking areas but simultaneously does not interfere with the coupling of cans together using common coupling means including the "6-pack" rings that are very common today, these rings snugly fitting over the lip or rim on the outside surface thereof.

Still other advantages and benefits of the invention will become apparent to those skilled in the art upon a reading and understanding of the following summary and detailed description.

Accordingly, the present invention satisfies these and other objectives as it relates to seals for food and beverage containers such as soft drink, beer, and/or soup cans.

BRIEF DESCRIPTION OF THE DRAWINGS

Preferred embodiment of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
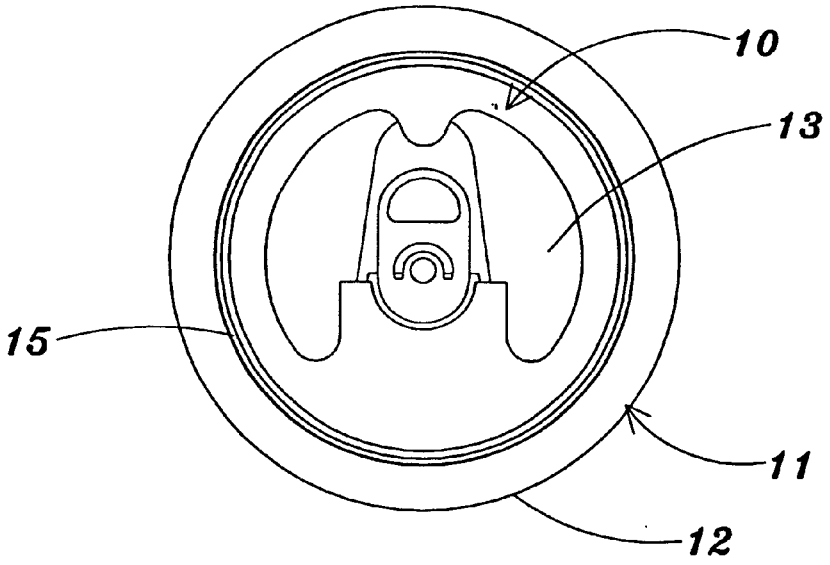
FIG. 1 is a top plan view of the seal of the present invention on a typical soda or pop can.
Figure 2:
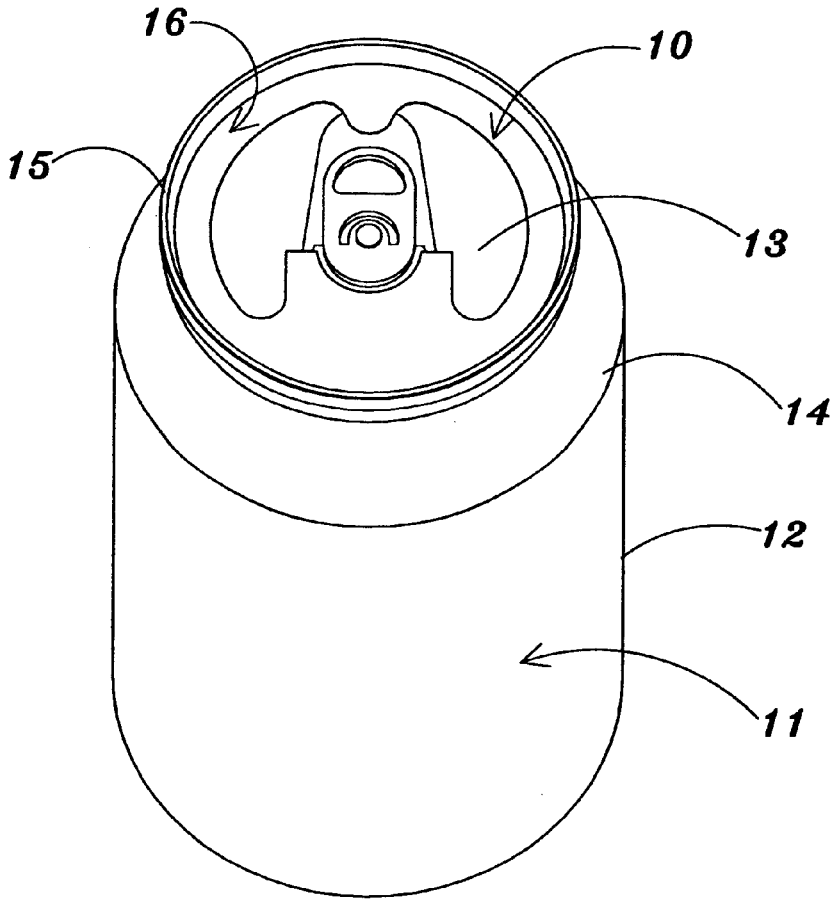
FIG. 2 is an isometric view of the seal as shown in FIG. 1 on the typical soda or pop can as shown in FIG. 1.
Figure 3:
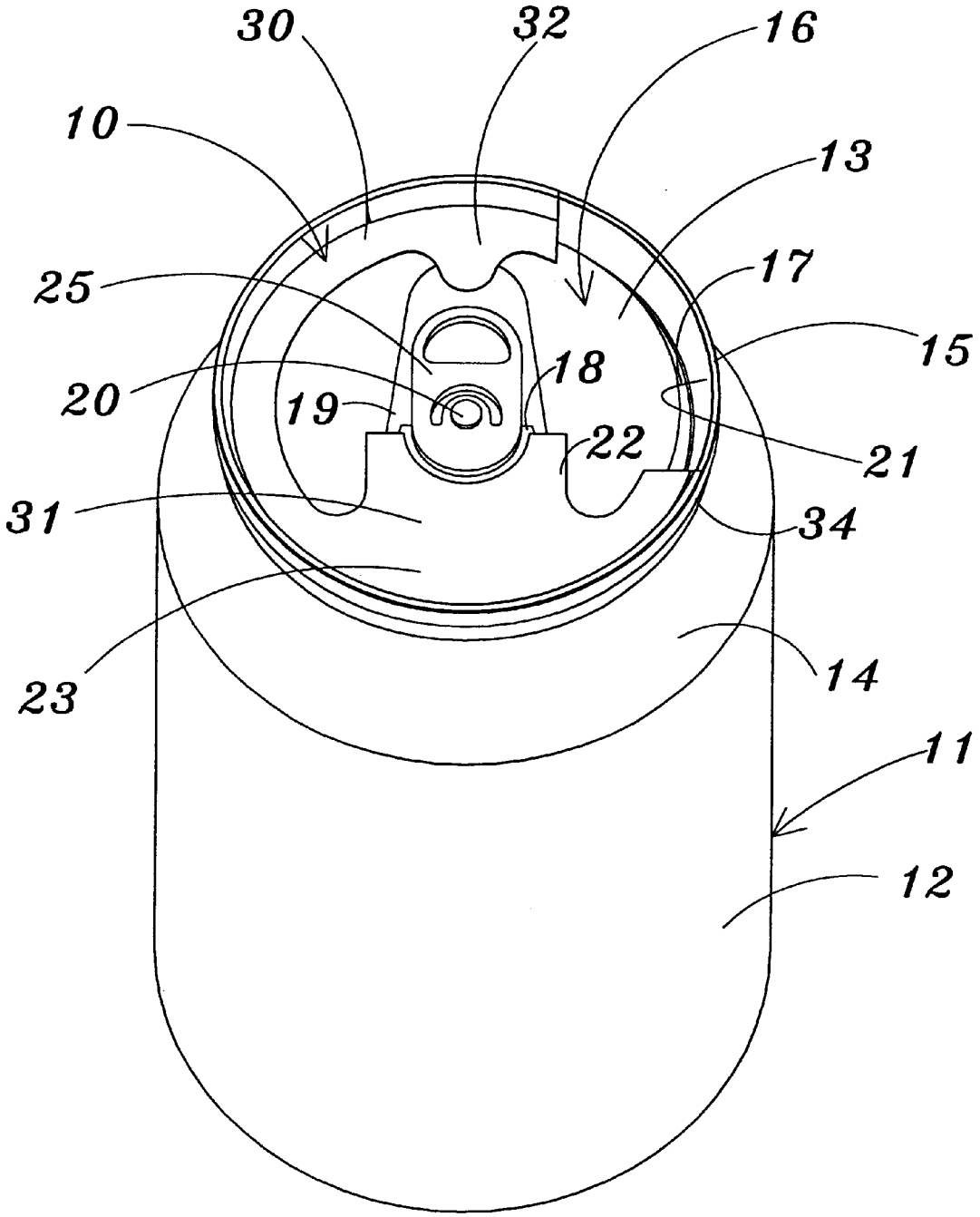
FIG. 3 is an enlarged isometric view of FIG. 2 with a portion of the seal removed to show its filling of the trough and coverage of the outermost portion of the end wall and the inner and top faces of the rim.
Figure 4:
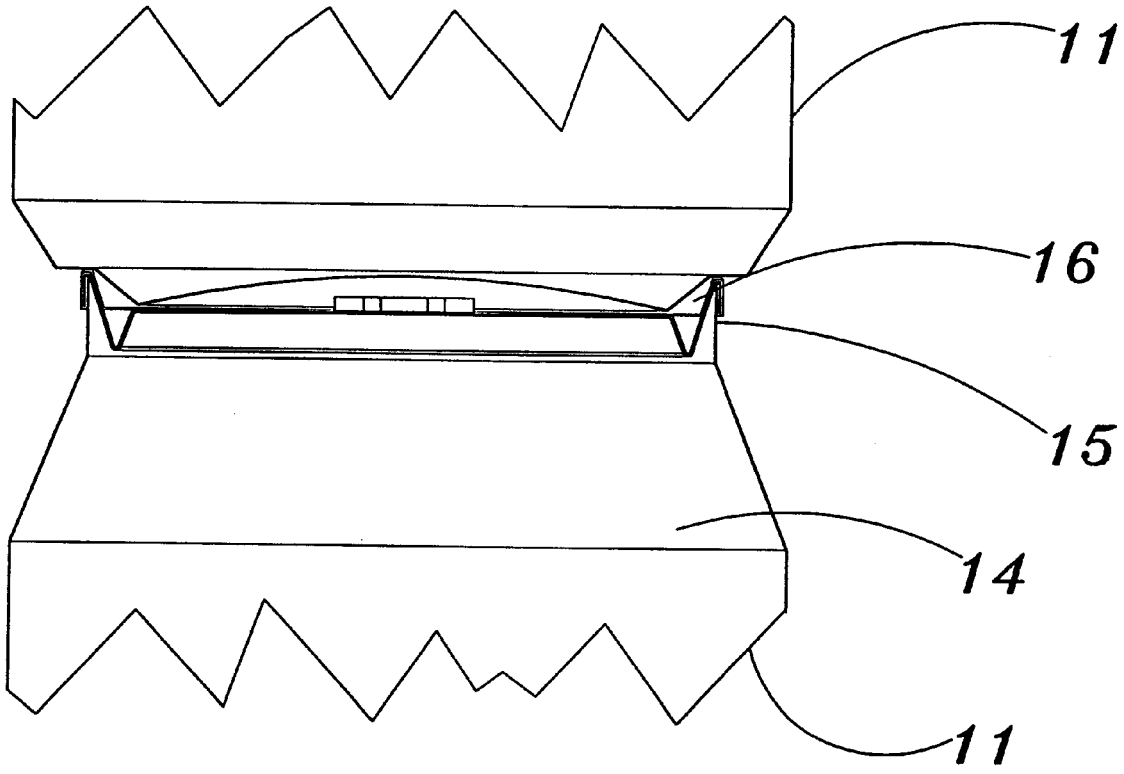
FIG. 4 is a fragmentary side elevational view of a pair of typical soda or pop cans stacked one on top of the other where a seal of the present invention is positioned on one of the cans and fills its trough while covering the outermost portion of one end wall and the inner and top faces of the rim.

The seal of the present invention is indicated generally at 10 as is best shown overall in FIGS. 1–3 while in sectional detail in FIG. 4. The seal 10 is shown in the FIGS. 1–4 on a soda or pop can 11 although the seal is equally applicable to any other container where contamination of a portion or all of the container surface is an issue.

The soda or pop can 11, as best shown in FIGS. 2–3, includes a cylindrical side wall 12 with a pair of end walls, namely top end wall 13 and bottom end wall (not shown), at opposing ends of wall 12. On many embodiments of cans, the can 11 includes a tapered transition 14 on the side wall 12 as it nears the each of the end walls 13.

Different manufacturing techniques exist for creating the can 11 and particularly for defining the end and side walls. In some manufacturing techniques the end walls are separate pieces that are attached by crimping or other known leak-proof attachment techniques. In other and more common manufacturing techniques, one of the end walls (typically the end wall without the tab and depressible door therein) is formed with the side wall 12 during a stamping or forming process resulting in an open ended container (no second end yet) whereby after the contents are poured in the other end wall (typically the end wall with the tab and depressible door) is crimped or otherwise attached.

A can 11 resulting from this second manufacturing process is shown in FIGS. 1–3 where a rim 15 is formed by the crimping of the top end wall 13 to the side wall 12. This rim 15 extends axially outward from the end wall 13 thereby defining an indented end pocket 16. A circular trough 17 is indented in the end wall 13 within the end pocket 16 adjacent the rim 15 as is well known in the art.

The top end wall 13 includes content access means which generally include a pull or lift tab 25 adjacent a removable or repressible door 18 defined by a scored, etched or otherwise weakened line 19 in the end wall 13. The lift tab 25 is pivotally connected to approximately the center of the top end wall 13 by a rivet 20 or like fastener. The lift tab 25 further includes a fulcrum point against which the tab rests against the end wall during actuation, and a free or lift portion from which a consumer actuates the tab in the well known manner of opening cans. The fulcrum point is always within the closed or substantially closed area defined by the scored line 19 known as the depressible door 18. This fulcrum point then serves to force the removable or repressible door 18 downward by breaking the door at least in part from the top end wall 13 along the weakened or scored line 19 as is well known in the art.

In accordance with one of the features of the present invention, seal 10 is provided on top end wall 13 to prevent contamination of the critical portions of the top end wall. Specifically, the seal 10 serves to cover the trough 17, the inner surface 21 of the rim 15, the surface of removable or repressible door 18, a small portion 22 of the area around the door 18 or score line 19, and a drinking area 23 which is defined as the area between door 18 and the nearest portion of the trough 17.

In accordance with another of the features of the invention, the seal 10 is a thin, polymeric or plastic seal that is flexible, non-toxic, and capable of being adhered to the can 11 either directly or using an adhesive while still being peelable or otherwise removable in a user friendly manner. The seal 10 must securely adhere to the can so as to remain thereon throughout storage, transportation, stacking, etc. in both high and low temperatures, but still be readily and easily removable by a positive force. It is also critical that the seal not be tacky or otherwise sticky so as to be accidentally removable by an adjacent can that was stacked thereon when such can is unstacked. Similarly, the seal must also not be susceptible to accidentally removal when sticky beverage leaks onto it and an adjacent can is removed.

It is also preferred but not critical that seal 10 be non-porous, and clear or transparent. The non-porous nature is not critical but it is important that contaminants not be able to penetrate the seal and thereby defeat its purpose. The clear or transparent nature is also not critical but it is beneficial to be able to see through the seal suGh as for the purpose of verifying that the scored line of the removable or depressible door has not been broken.

Further in accordance with the invention and in the preferred embodiment, the seal 10 is of an annular or ring-like construction as best shown in FIGS. 1–3. Specifically, the seal 10 includes an annular portion 30, an inwardly extending door cover 31, and an inwardly extending lift tab 32.

Figure 5:
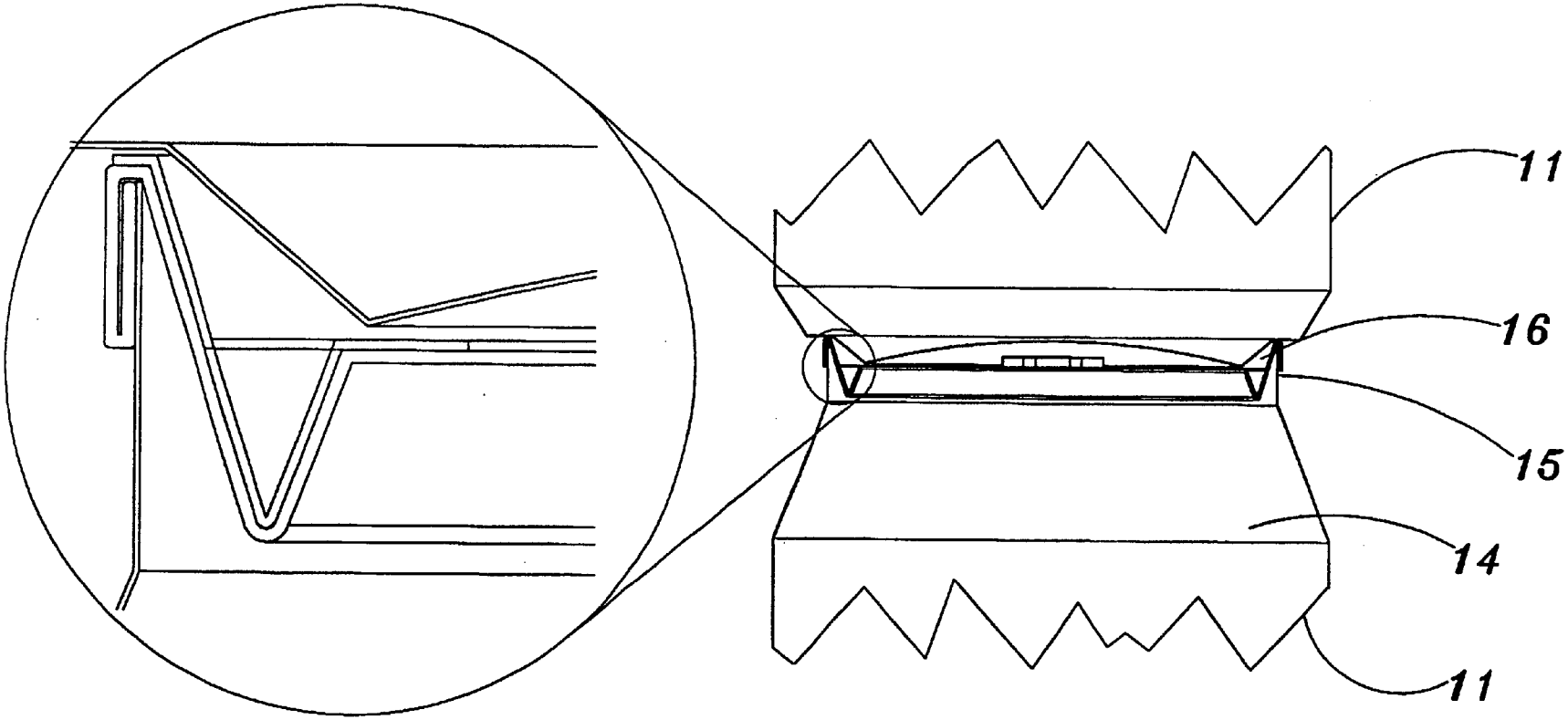
FIG. 5 is the same fragmentary side elevational view as in FIG. 4 except the seal of the present invention seats in its trough rather than filling it or spanning it as in FIG. 4.

The annular portion 30 is ring-like as shown in FIGS. 1–3. This annular portion 30 either (1) fills the trough 17 or spans over the trough 17 as shown in FIG. 4 and extends over the inner surface 21 of the rim 15, or (2) seats down in the trough 17 as shown in FIG. 5 and extends over the inner surface 21 of the rim 15. This serves to prevent contaminants from accumulating in the trough or on the inner surface which are areas likely to come in contact with a consumer's mouth during drinking from the can 11, or in contact with the fluid contents therein during pouring of the fluid contents. The annular portion 30 is thin in thickness and does not inhibit stacking of cans one on top of the other as is common in the soda and pop can industry. The thin seal 10 follows the contours of the can 11 including the trough 17 (FIG. 5) and the inner surface 21 of the rim 15. The seal 10 may extend up and over the top edge of the rim 15, but the seal in no way extends down onto the outer surface 34 of the rim 15 where the standard "6-pack" rings tightly fit. As a result, this design does not interfere with the usage of such "6-pack" rings as is very popular in the soft drink industry.

The inwardly extending door cover 31 is a radially inward extension of the annular portion 30 in the area of the removable or depressible door 18 and score line 19. This door cover 31 serves to prevent contamination on the surface of removable or repressible door 18, on the small portion 22 of the area around the door 18 or score line 19, and on the drinking area 23 which is defined as the area between door 18 and the nearest portion of the trough 17. The door cover 31 extends inward from the annular portion 30 to the lift tab 25 and preferably tightly around the lift tab 25 as shown best in FIGS. 1–3. This prevents as many contaminants as possible from reaching and depositing on the or around the door 18. The door cover 31 may alternatively extend under the lift tab 25 and cover the entire door 18; however, this makes peeling away of the door cover 31 more difficult as it may tear or otherwise get hung up on the lift tab 25.

The inwardly extending lift tab 32 provides an easy, user friendly way of removing the seal 10 at the time of use. The tab 32 is a radially inward extension of the annular portion 30 in an area spaced apart from the door cover 31, and in the embodiment shown opposed from the door cover 31. The tab 32 is any projection of the seal that is not adhered or otherwise tightly covering a portion of the can so as to be available for grasping and initial pulling of the seal. In FIGS. 1–3, the tab 32 is almost a semi-cylindrical radially inward projection.

In use, seal 10 is a polymeric or plastic material that is deposited on the top of the can in any known manner including stretching a sheet of material over the can, molding or extruding directly a film onto the can, etc. The film is formed and/or deposited so as to form the shape shown in FIGS. 1–3 where seal 10 includes annular portion 30, inwardly extending door cover 31, and inwardly extending lift tab 32. The door cover 31 is sized, shaped and positioned so as to cover the area of the removable or depressible door 18 and score line 19. The lift tab 32 is generally positioned opposite thereof as shown in FIGS. 1–3. The annular portion 30 is seated in, fills in, extends or spans over, and/or covers overs the trough 17 and the inner surface 21 of the rim 15.

As a result of such use, the trough 17 and inner surface 21 of the rim 15 remain contaminant free (no dirt, spilled beverage, etc.). Similarly, the door 18, score line 19, and the area adjacent thereto also remain contaminant free. As a result, the areas that are likely to come in contact with either the consumer's mouth and lips, or the beverage when poured, remain contaminant free because the seal 10 covers these areas. When drinking, pouring or using is desired, the seal is removed by pulling up on tab 32 resulting in the seal being separated therefrom whereby a contaminant free trough 17, inner surface 21, door 18, score line 19, and area adjacent thereto is provided.

In addition, to the objectives and advantages described in the previous paragraph, the invention also allows for use of standard "6-pack" rings as the outer surface of the rim 15 is not affected by the seal 10. In addition, the cans 11 are stackable as is well known in the art as the seal 10 does not affect such stacking due to its positioning and thin film characteristics.

Accordingly, the seal for beverage and food cans is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the invention's description and illustration is by way of example, and the invention's scope is not limited to the exact details shown or described.

Having now described the features, discoveries and principles of the invention, the manner in which the seal is constructed and used, the characteristics of the construction, and the advantageous, new and useful results obtained; the new and useful structures, devices, elements, arrangements, parts and combinations, are set forth in the appended claims.

I claim:

1. A seal for use on a food or beverage storage container where the container includes a cylindrical side wall with a pair of end walls defining a storage chamber therein, at least one of the end walls including a depressible door therein and an outwardly extending rim and trough circumferentially positioned in the radially outermost portion of the end wall, the seal comprising:

an annular portion extending into and adhered to the trough and over an inner surface of the rim and further up onto and terminating at a top edge of the rim, whereby an outer surface of the rim is lacking of any seal thereby allowing for receiving of a 6-pack ring and whereby the annular portion is a thin membrane that allows for stacking of the containers;

a door cover portion radially extending inward from the annular portion and adhering to the depressible door and an area adjacent thereto; and a pull tab attached to the seal and not adhered to the container.

2. The seal of claim 1 wherein the door cover portion covers substantially all of the depressible door.

3. The seal of claim 1 wherein the door cover portion covers substantially all of the depressible door while avoiding a pull tab attached to the end wall for opening the depressible door.

4. The seal of claim 1 wherein the annular portion extending into and adhered to the trough tapers from the inner surface of the rim to the end wall.

5. A seal for use on a food or beverage storage container where the container includes a cylindrical side wall with a pair of end walls defining a storage chamber therein, at least one of the end walls including a depressible door therein and an outwardly extending rim and trough circumferentially positioned in the radially outermost portion of the end wall, the seal comprising:

a thin membrane covering at least a portion of one of the end walls including the depressible door therein, where the thin membrane extends into and adheres to the trough in that end wall and over an inner surface of the rim adjacent the trough and further up onto and terminating at a top edge of the rim while an outer surface of the rim is lacking of any seal thereby allowing a 6-pack ring to be tightly fitted around the outer surface of the rim.

6. The seal of claim 5 wherein the thin membrane includes an annular portion that extends into and adheres to the trough and over the inner surface of the rim.

7. The seal of claim 6 wherein the thin membrane includes a door cover portion radially extending inward from the annular portion and adhering to the depressible door and an area adjacent thereto.

8. The seal of claim 7 wherein the thin membrane includes a pull tab attached to the seal and not adhered to the container.

9. The seal of claim 7 wherein the door cover portion covers substantially all of the depressible door.

10. The seal of claim 9 wherein the door cover portion covers substantially all of the depressible door while avoiding a pull tab attached to the end wall for opening the depressible door.

11. The seal of claim 6 wherein the annular portion extending into and adhered to the trough tapers from the inner surface of the rim to the end wall.

12. The seal of claim 1 wherein the seal is stretched over the end wall of the can.

13. The seal of claim 5 wherein the seal is stretched over the end wall of the can.

* * * * *